US010589966B2

(12) United States Patent
Hull

(10) Patent No.: US 10,589,966 B2
(45) Date of Patent: Mar. 17, 2020

(54) JIB COUPLING SYSTEM FOR JIB STOWAGE

(71) Applicant: Manitowoc Crane Companies, LLC, Manitowoc, WI (US)

(72) Inventor: William Edward Hull, Greencastle, PA (US)

(73) Assignee: Manitowoc Crane Companies, LLC, Milwaukee, WI (US)

( * ) Notice: Subject to any disclaimer, the term of this patent is extended or adjusted under 35 U.S.C. 154(b) by 196 days.

(21) Appl. No.: 15/905,336

(22) Filed: Feb. 26, 2018

(65) Prior Publication Data

US 2018/0251347 A1 Sep. 6, 2018

Related U.S. Application Data

(60) Provisional application No. 62/466,132, filed on Mar. 2, 2017.

(51) Int. Cl.

| | |
|---|---|
| ***B66C 23/68*** | (2006.01) |
| ***B66C 23/42*** | (2006.01) |
| ***B66C 23/70*** | (2006.01) |

(52) U.S. Cl.

CPC ..... *B66C 23/68* (2013.01); *B66C 23/42* (2013.01); *B66C 23/702* (2013.01)

(58) Field of Classification Search

CPC ..... B66C 23/00; B66C 23/42; B66C 23/62; B66C 23/64; B66C 23/68; B66C 23/70; B66C 23/701; B66C 23/702; B66C 23/82

See application file for complete search history.

(56) References Cited

U.S. PATENT DOCUMENTS 3,430,778 A 3/1969 Brown
3,698,569 A * 10/1972 Lamer ..... B66C 23/702 212/177

(Continued)

FOREIGN PATENT DOCUMENTS

DE 20007050 U1 8/2001
JP 2001302181 A 10/2001

OTHER PUBLICATIONS

Extended European Search Report dated Jul. 25, 2018 issued in connection with corresponding European Patent Application No. 18159691.7.

*Primary Examiner* — Michael R Mansen
*Assistant Examiner* — Juan J Campos, Jr.
(74) *Attorney, Agent, or Firm* — Levenfeld Pearlstein, LLC

(57) ABSTRACT

A jib coupling system a stowage coupling assembly having a locking member movable between a retracted position and an extended position, an extension pivot coupling system having a coupling member movable between a retracted position and an extended position, and a cable having a first end operably connected to the locking member and a second end having a locking pin. Movement of the locking member from the extended position to the retracted position causes the locking pin to engage the coupling member, and movement of the locking member from the retracted position to the extended position causes the locking pin to disengage the coupling member. The jib coupling system may be implemented as a part of a boom assembly and on a boom assembly of a mobile crane.

20 Claims, 12 Drawing Sheets

(56) References Cited

U.S. PATENT DOCUMENTS

| | | | | | |
|---|---|---|---|---|---|
| 3,785,505 | A | * | 1/1974 | Keller, Jr. | B66C 23/702 212/177 |
| 3,830,376 | A | * | 8/1974 | Fritsch | B66C 23/702 212/350 |
| 3,831,771 | A | * | 8/1974 | Wiencek | B66C 23/702 212/300 |
| 4,141,455 | A | | 2/1979 | Henderson et al. | |
| 4,431,109 | A | | 2/1984 | Behrendt et al. | |
| 4,483,447 | A | * | 11/1984 | Bernabe, Jr. | B66C 23/702 212/177 |
| 4,491,229 | A | | 1/1985 | Behrendt et al. | |
| 5,111,945 | A | | 5/1992 | Hull et al. | |
| 5,673,805 | A | | 10/1997 | Chaffin | |
| 6,036,035 | A | | 3/2000 | Asano et al. | |
| 6,131,750 | A | | 10/2000 | Harrington | |
| 7,337,912 | B1 | | 3/2008 | Hull | |
| 7,878,346 | B1 | | 2/2011 | Watts et al. | |
| 8,522,988 | B2 | | 9/2013 | Tanaka et al. | |
| 2004/0104192 | A1 | | 6/2004 | Stowasser et al. | |
| 2011/0147331 | A1 | * | 6/2011 | Tanaka | B66C 23/42 212/299 |
| 2014/0231374 | A1 | | 8/2014 | Bronson et al. | |
| 2017/0305726 | A1 | * | 10/2017 | Harauchi | B66C 23/70 |
| 2018/0118526 | A1 | * | 5/2018 | Harauchi | B66C 23/70 |
| 2018/0118527 | A1 | * | 5/2018 | Harauchi | B66C 23/70 |

* cited by examiner

JIB COUPLING SYSTEM FOR JIB STOWAGE

BACKGROUND

The following description relates generally to jib stowage, and in particular, to a jib coupling system for stowing a jib on a boom.

A lifting vehicle, such as a mobile crane, may have a telescoping boom comprised of a base section and one or more nested telescoping sections, extendable from, and retractable into the base section. In some boom configurations, a boom extension or jib may be affixed to a boom nose of the telescoping boom.

With reference to FIG. 1, in some mobile cranes, the jib 110 may be stowed along a side or top of the base section 112 of the boom 114 when not in use. In a stowed configuration, the jib 110 may be positioned having its base 116 generally adjacent to the boom nose 118, and its tip 120 positioned near a base 122 of the base section 112.

Typically, the jib extension will be stowed by way of a first stowage connection 124 at or near the tip 120 of the jib 110 and the base 122 of the base section 112, and a second stowage connection 126 positioned in an intermediate area between the jib tip 120 and the jib base 116, and between the base 122 of base section 112 and the boom nose 118.

In known jib stowage arrangements, the first stowage connection 124 may be released, as shown in FIG. 2, and the jib 110 can be pivoted about the second stowage connection 126 to move the a portion of the base 116 of the jib 110 into alignment with a portion of the boom nose 118. The respective portions of the jib base 116 and boom nose 118 may be connected to one another and serve as a pivot joint 128.

With respective portions of the jib base and boom nose 118 connected, the second stowage connection 126 may be released and the jib 110 may pivot around the pivot joint 128. Accordingly, the jib base 116 may be brought into alignment with the boom nose 118, along an axis of the boom 114, to secure the jib base 116 to the boom nose 118 and extend the boom 114.

One drawback to the known jib stowage arrangement above is that when moving the jib 110 from the stowed position to an operating position (i.e., connected to and installed at the boom nose 118), if the connection at the pivot joint 128 is not secure after the second stowage connection is released, the jib 110 may fall from the boom 114. Conversely, when moving from the jib 110 from the operable position to the stowed position, the jib 110 may fall from the boom if the second stowage connection 126 is not secured upon release of the pivot joint 128.

Efforts have been made to address the drawback described above. For example, U.S. Pat. No. 8,522,988 to Tanaka et al., includes a pair of pin retraction restriction means. In particular, Tanaka et al. discloses upper and lower pivot pins at a location corresponding to the pivot joint described above. The upper and lower pivot pins are movable away from one another to an extended position to couple the jib to the boom nose, and toward one another to a retracted position to decouple the jib from the boom nose. Tanaka et al. also discloses upper and lower coupling pins at a location corresponding to the second stowage connection described above. Similar to the pivot pins, the upper and lower coupling pins are movable away from one another to an extended position, whereby the jib may be coupled to the boom, and toward one another to a retracted position whereby the jib may be decoupled from the boom.

In Tanaka et al., one of the pin retraction restriction means includes a first restricting member and the other of the pin retraction restriction means includes a second restricting member. The first and second restricting members are pivoting arms urged by a spring into a gap formed between the pivot pins and coupling pins, respectively, when the pivot and coupling pins are in extended positions. Accordingly, the first and second restricting means may prevent retraction of the pivot pins and coupling pins.

In addition, the first and second restricting means are each connected, at an opposite end from the spring connection, to respective control cables. The control cable of the first restricting member is connected at an opposite end to the upper coupling pin, such that movement of the upper coupling pin to the extended position causes the control cable to pull the pivot arm of the first restricting member, against a biasing force, out of the gap between the upper and lower pivot pins. The control cable of the second restricting member is connected at an opposite end to the upper pivot pin, such that movement of the upper pivot pin to the extended position causes the control cable to pull the pivot arm of the second restricting member, against a biasing force, out of the gap between the upper and lower coupling pins.

Thus, movement of the coupling pins to the extended position causes the first restricting member to pivot out of gap between the upper and lower pivot pins, thereby allowing the pivot pins to retract. Similarly, movement of the pivot pins to the extended position causes the second restricting member to pivot out of a gap between the upper and lower coupling pins, thereby allowing the coupling pins to retract. In this manner, Tanaka et al. seeks to maintain a connection of at least one of the pivot pins or coupling pins to the boom at all times.

However, the arrangement described above is mechanically complex and requires numerous connections between moving parts. For example, each control cable is required to be connected at each end to either a pivot arm or a coupling or pivot pin to pull the cable in a predetermined direction. In addition, because of the number of moving parts, which are typically exposed to the environment, and the nature of working environments in which such a system is typically used, the pin retraction restriction system above may not be sufficiently durable, and could require frequent maintenance. This results in machine down time and increased service and maintenance costs.

Accordingly, it is desirable to provide a jib coupling system that maintains the jib in connection with the boom during movement from a stowed condition to an extended condition, and vice versa, with fewer components and reduced mechanical complexity

SUMMARY

According to one embodiment, a jib coupling system for coupling a jib to a boom includes a stowage coupling assembly having a locking member movable between a retracted position and an extended position, an extension pivot coupling system having a coupling member movable between a retracted position and an extended position, and a cable having a first end operably connected to the locking member and a second end having a locking pin. Movement of the locking member from the extended position to the retracted position causes the locking pin to engage the coupling member, and movement of the locking member from the retracted position to the extended position causes the locking pin to disengage the coupling member.

According to another embodiment, a boom assembly for a construction vehicle includes a boom having a base section and boom nose, a jib movable relative to the base section between a stowed condition and an extended condition, and a jib coupling system configured to couple the jib to the boom. The jib coupling system includes a stowage coupling assembly having a locking member movable between a retracted position and an extended position, an extension pivot coupling system having a coupling member movable between a retracted position and an extended position and a cable having a first end operably connected to the locking member and a second end having a locking pin. Movement of the locking member from the extended position to the retracted position causes the locking pin to engage the coupling member, and movement of the locking member from the retracted position to the extended position causes the locking pin to disengage the coupling member.

According to still another embodiment, a mobile crane includes a boom assembly having a base section, a boom nose, and a jib movable relative to the base section between a stowed condition and an extended condition, and a jib coupling system configured to couple the jib to the boom. The jib coupling system includes a stowage coupling assembly having a locking member movable between a retracted position and an extended position, an extension pivot coupling system having a coupling member movable between a retracted position and an extended position and a cable having a first end operably connected to the locking member and a second end having a locking pin. Movement of the locking member from the extended position to the retracted position causes the locking pin to engage the coupling member, and movement of the locking member from the retracted position to the extended position causes the locking pin to disengage the coupling member.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
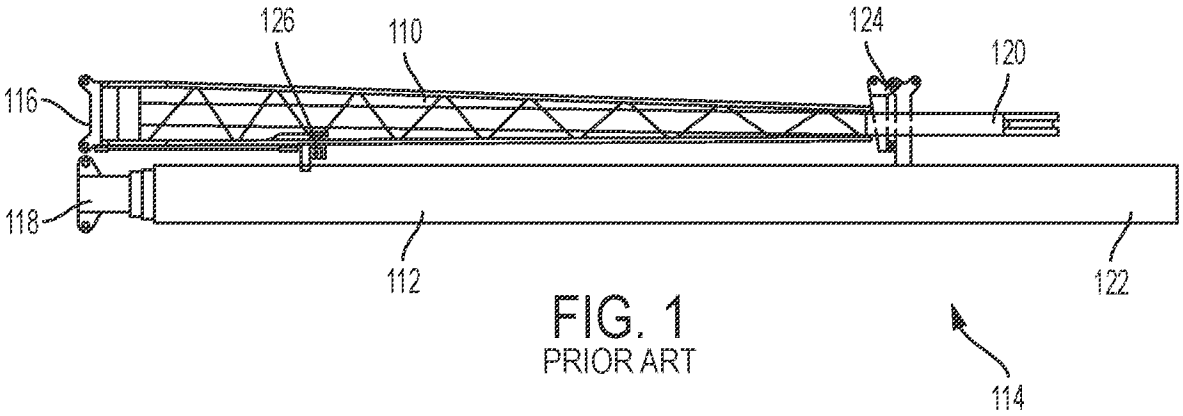
FIG. 1 PRIOR ART
FIG. 1 illustrates a known jib in a stowed position attached to a telescoping boom.
Figure 2:
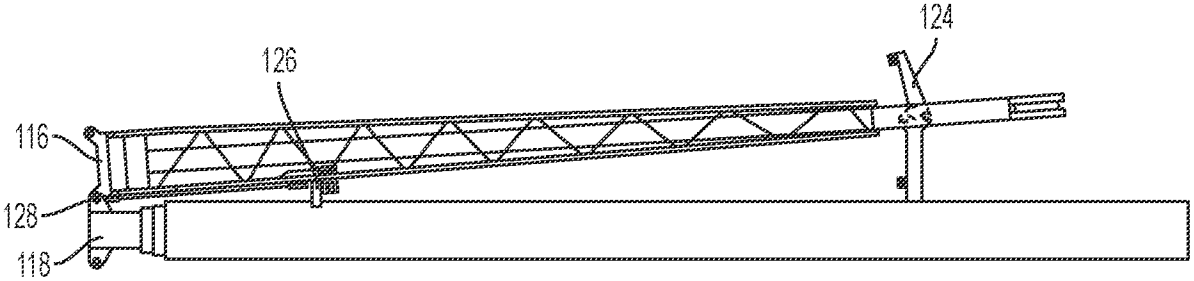
FIG. 2 PRIOR ART
FIG. 2 illustrates the known jib of FIG. 1 moved to an intermediate position between the stowed position and an operating position.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 3:
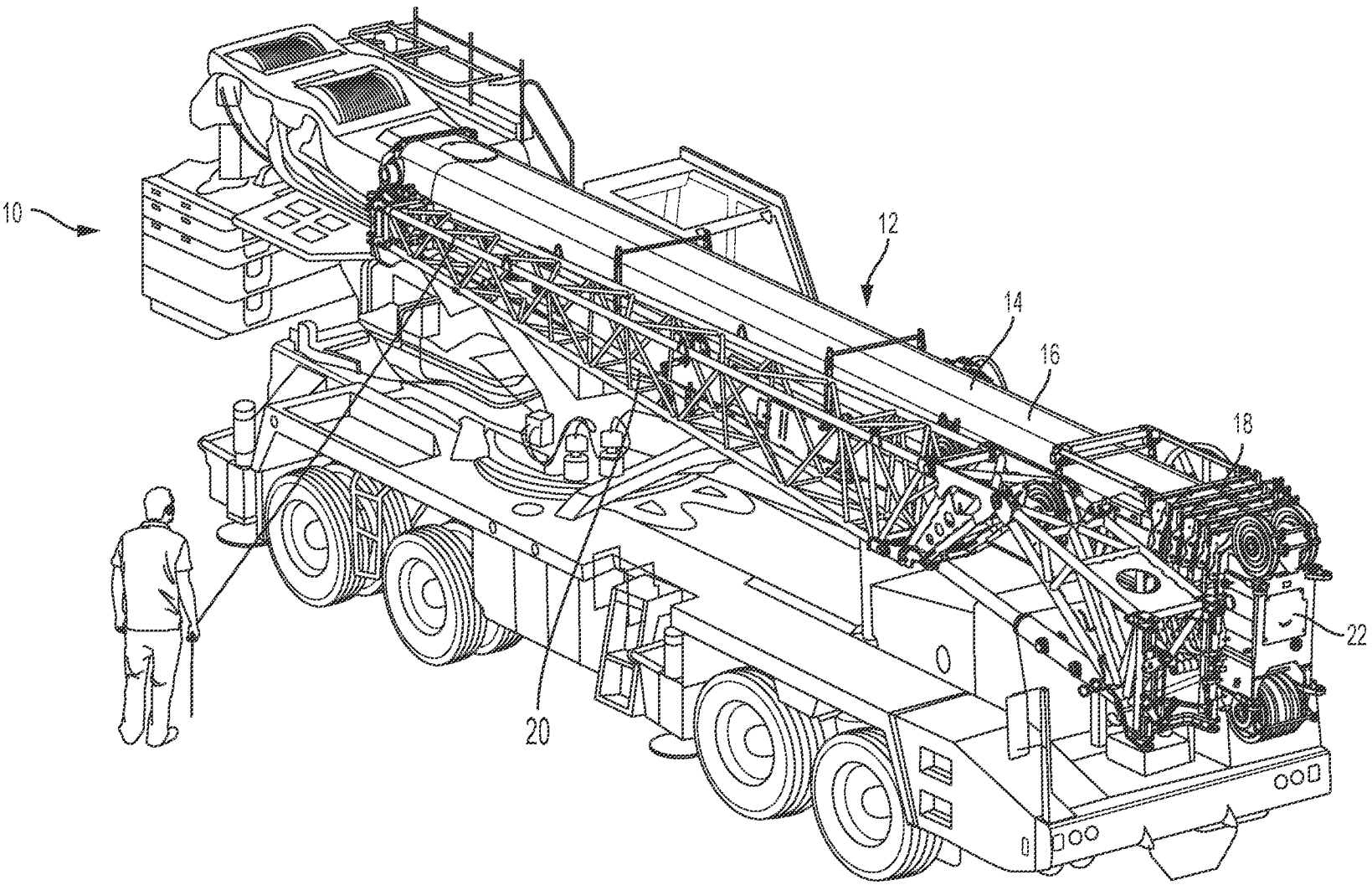
FIG. 3 is a perspective view of a lifting vehicle having a boom with a jib in a stowed position, according to an embodiment described herein.

FIG. 3 is a perspective view of a construction vehicle 10 having a boom assembly 12 according to an embodiment described herein. The construction vehicle 10 may be, for example, a mobile crane. The boom assembly 12 includes a boom 14 having a base section 16. In one embodiment, the boom 14 is a telescoping boom and includes one or more telescoping sections 18 nested within the base section 16 and configured for telescoping movement out of and into the base section. In one embodiment, the telescoping boom 14 may be a hydraulic boom and individual boom sections 18 are driven to extend or retract by a linear actuator, such a hydraulic piston (not shown).

The boom assembly 12 further includes a boom extension, or jib 20, configured for selective connection to a distal end of the boom, i.e., the boom nose 22. The jib 20, in one embodiment, is a lattice jib. In general, the jib 20 is movable relative to the boom 14 between a stowed condition (FIG. 3) and an extended condition (not shown) where the jib 20 is installed on the boom nose 22 to extend a length of the boom 14. In the stowed condition, the jib 20 is generally positioned alongside the boom 14 and is secured to the base section 16 at one or more couplings, referred to herein generally as stowage couplings. In the extended condition, the jib 20 is secured to the boom nose 22 at another coupling, referred to herein generally an extension pivot coupling assembly.

Figure 4:
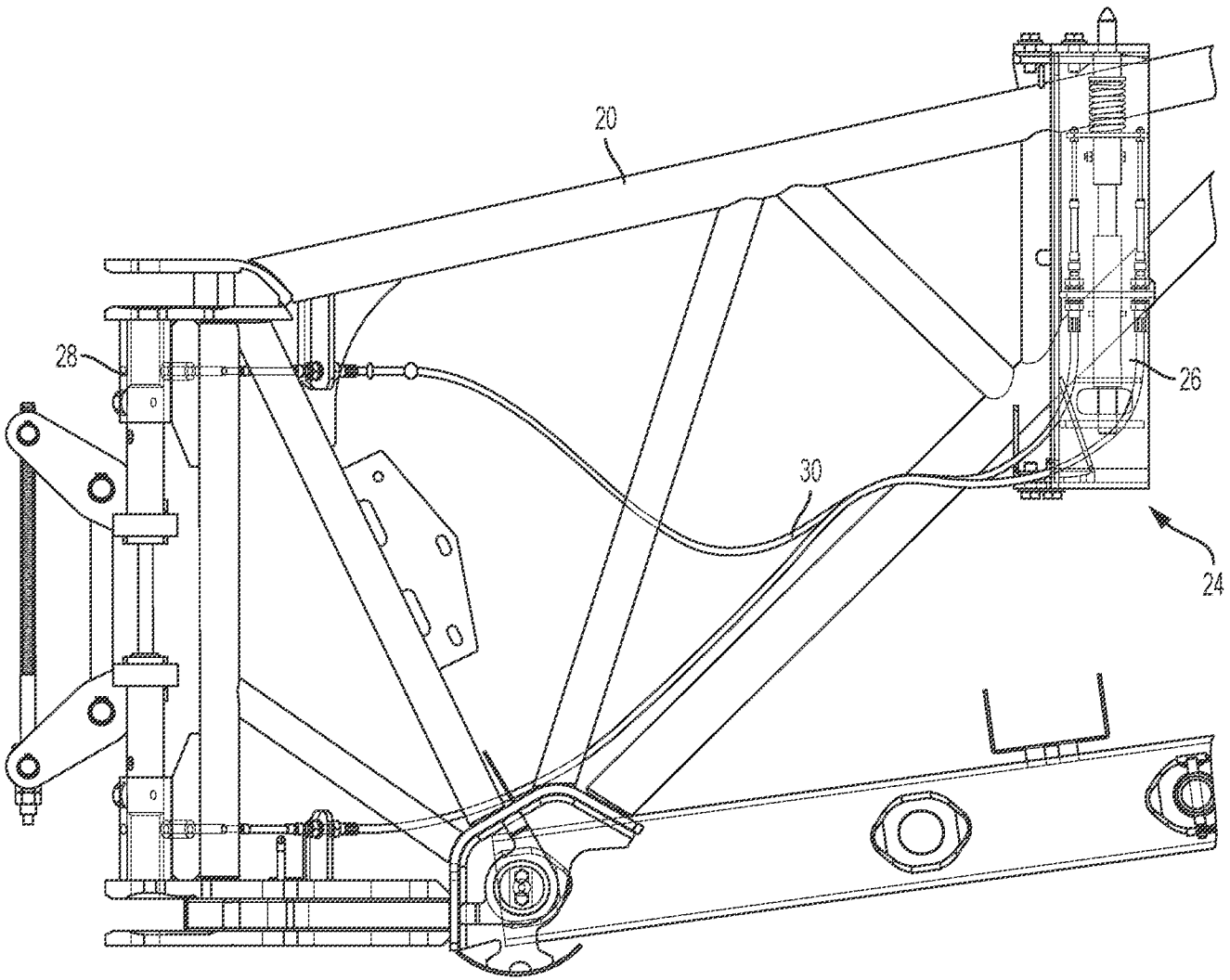
FIG. 4 is a side view of a jib coupling system for use with a jib, in a stowage condition, according to an embodiment described herein.

Referring to FIGS. 3 and 4, according to the embodiments described herein, the jib 20 is secured to the boom 14 with, and is movable between the stowed condition and extended condition by operation of a jib coupling system 24. FIG. 4 is a side view showing the jib coupling system 24 and a portion of the jib 20, according to an embodiment described herein. Referring to FIG. 4, the jib coupling system 24 generally includes a stowage coupling assembly 26, an extension pivot coupling assembly 28, and one or more cables 30 extending between the stowage coupling assembly 26 and the extension pivot coupling assembly 28.

Figure 5:
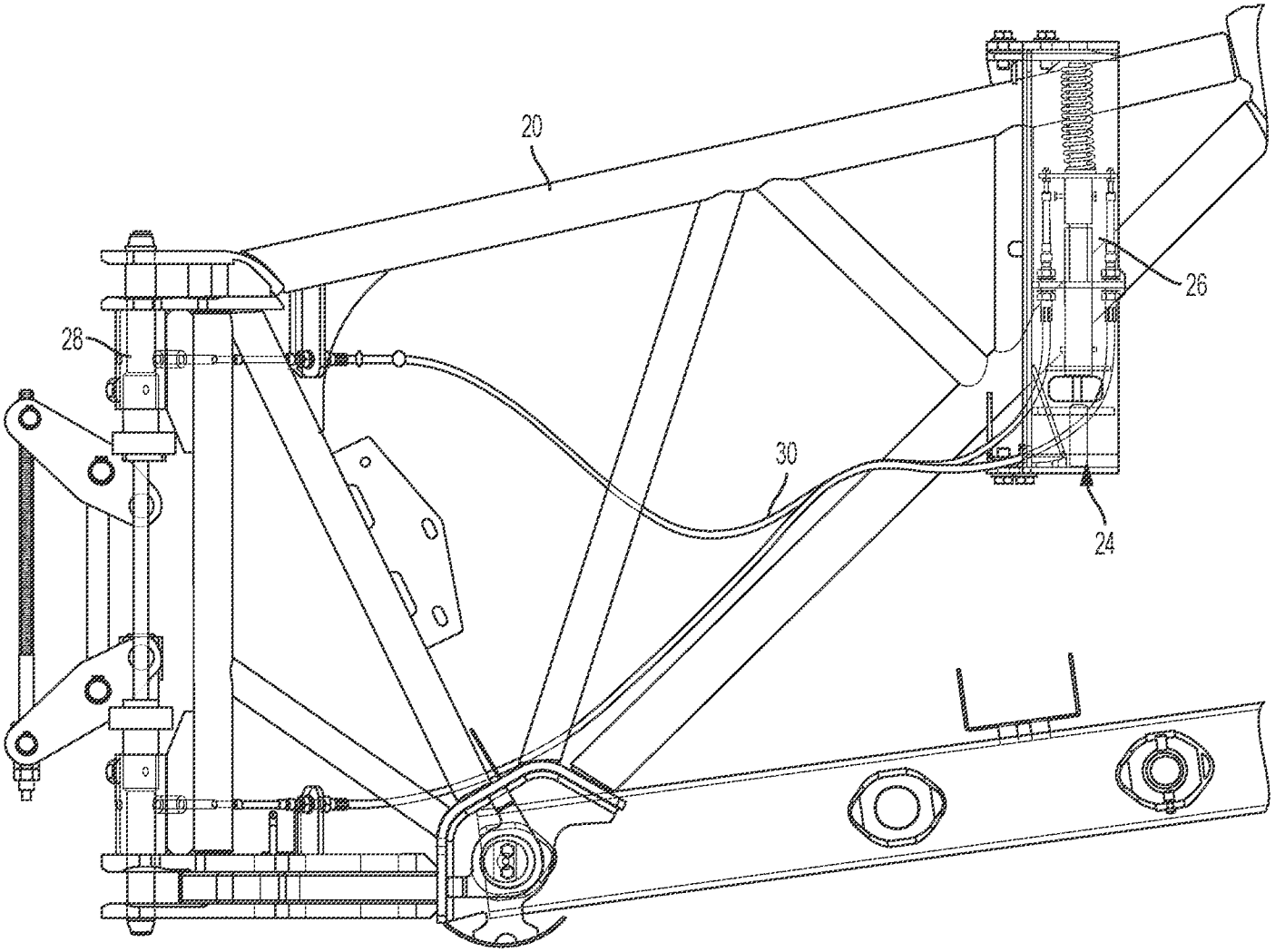
FIG. 5 is a side view of the jib coupling system of FIG. 4 in an extended condition, according to an embodiment described herein.

FIG. 5 is another side view of the jib coupling system 24 according to an embodiment described herein. Referring to FIGS. 4 and 5, and as will be described further below, the stowage coupling assembly 26 is operable to move between a locked condition (FIG. 4) and an unlocked condition (FIG. 5), and vice versa. Similarly, the extension pivot coupling assembly 28 is movable between a locked condition (FIG. 5) and an unlocked condition (FIG. 4), and vice versa. In one embodiment, the one or more cables 30 are push-pull type cables and may be moved (i.e., pushed or pulled) in response to actuation of the stowage coupling assembly 26. In one embodiment each cable of the one or more cables 30 may be formed by a cable configured for sliding movement within a substantially fixed sleeve.

Figure 6:
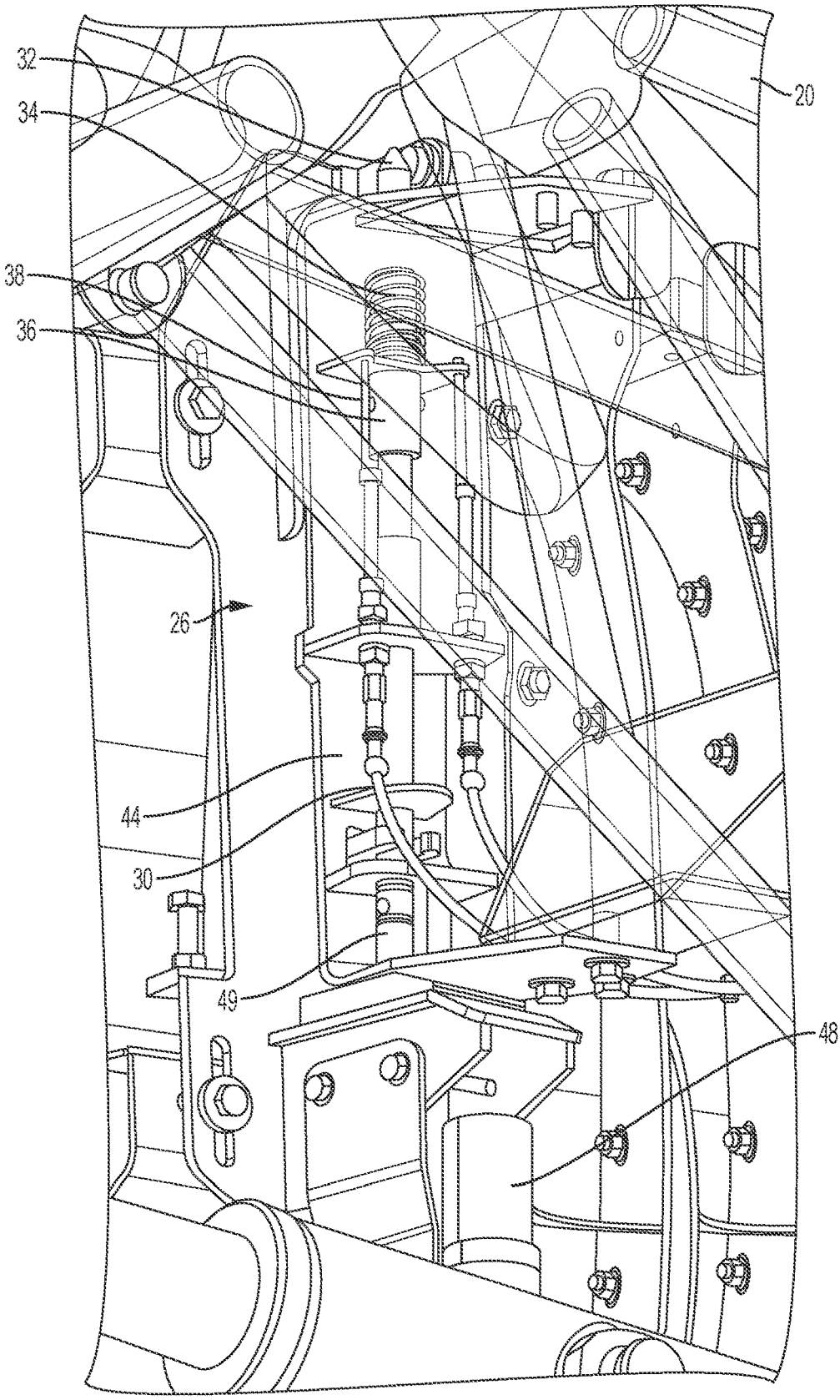
FIG. 6 is an enlarged view of a stowage coupling assembly of the jib coupling system of FIG. 3, in a stowage condition, according to an embodiment described herein.
Figure 7:
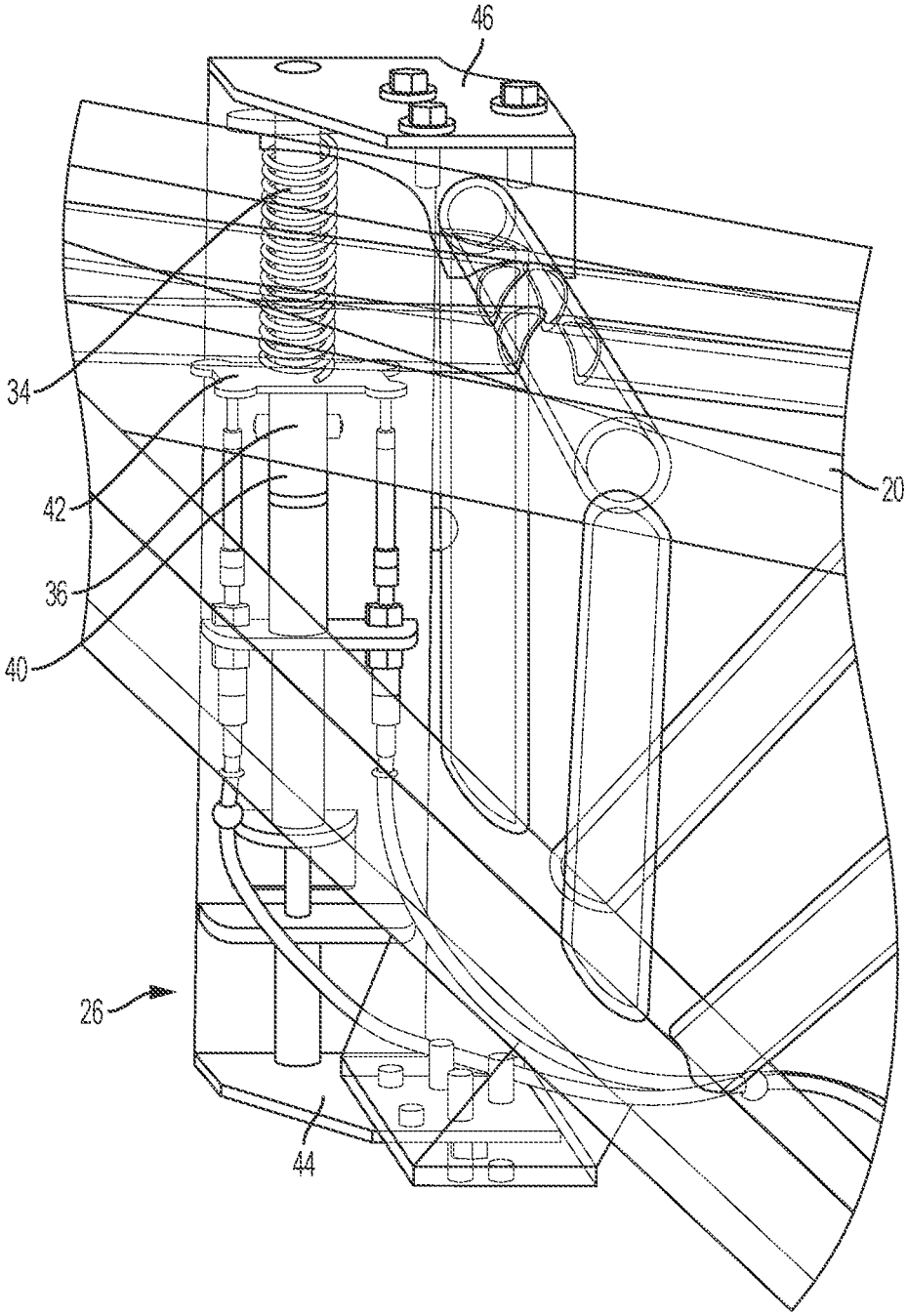
FIG. 7 is an enlarged view of a stowage coupling assembly of the jib coupling system of FIG. 3, in an extended condition, according to an embodiment described herein.

FIG. 6 is a perspective view of the stowage coupling assembly 26 and a portion of the jib 20, in the locked condition, according to an embodiment described herein. FIG. 7 is a perspective view of the stowage coupling assembly 26 and a portion of the jib 20 in the unlocked condition, according to an embodiment described herein. With reference to FIGS. 6 an 7, in one embodiment, the stowage coupling assembly 26 includes a locking member 32, which may be formed as a bolt, pin or the like. In one embodiment, the locking member 32 is substantially cylindrical in shape. The locking member 32 is movable between an extended position, which corresponds to the locked condition shown in FIG. 6, and a retracted position, which corresponds to the unlocked condition shown in FIG. 7.

In one embodiment, the stowage coupling assembly 26 also includes a biasing element 34 to urge the locking member 32 in a predetermined direction. For example, in the embodiments shown in FIGS. 6 and 7, the biasing element 34 urges the locking member 32 toward the retracted position shown in FIG. 7. The biasing element 34 may be, for example, a coil spring. In another embodiment, the biasing element 34 could be, for example, a torsion spring.

The stowage coupling assembly 26 may further include a support plate 36 operably connected to the locking member 32. In one embodiment, the support plate 36 acts as a seat for one end of the biasing element 34. Further, in one embodiment, the support plate 36 may be fixedly attached to the locking member 32, such that the support plate 36 moves with the locking member 32. In addition, a first end 38 of the one or more cables 30 may be attached to the support plate 36, such that movement of the locking member 32, and in turn, the support plate 36, causes movement of the one or more cables 30. It is understood, however, that the present disclosure is not limited to this configuration. For example, the biasing element 34 may be supported at a seat connected to the locking member 32 and the one or more cables 30 may be attached directly to the locking member 32, to a plate or to a similar mounting component connected to the locking member 32, separate from the seat.

As more clearly shown in FIG. 7, in one embodiment, the support plate 36 may include a first portion 40 fixedly attached to the locking member 32 and a second portion 42 extending outwardly from the first portion 40. For example, in the embodiment shown in FIGS. 6 and 7, the first portion 40 is formed as a collar into which the locking member 32 extends for attachment to the support plate 36, and the second portion 42 is formed as a plate extending outwardly from the collar. It is understood, however, that the present disclosure is not limited to this configuration.

Referring still to FIGS. 6 and 7, the stowage coupling assembly 26 may also include a bracket 44 to which the locking member 32 is mounted. In one embodiment, the bracket 44 optionally includes an upper end 46 having an opening through which the locking member 32 projects in the extended position. The upper end 46 of the bracket 44 may also serve as a seat for another end of the biasing element 34.

The stowage coupling assembly 26 also includes a locking member actuator 48. In one embodiment, the locking member actuator 48 may be, for example, a linear actuator such as a solenoid or a pneumatic or hydraulic piston cylinder system to drive the locking member 32 in at least one direction. For example, the locking member actuator 48 may drive the locking member 32 from the retracted position (FIG. 7) to the extended position (FIG. 6). In one embodiment, the locking member actuator 48 may then hold the locking member 32 in the extended position against a biasing force from the biasing element 24. For example, the locking member 48 may be locked or engaged in a position holding the locking member 32 in the extended position. Alternatively, or in addition, the locking member actuator 48 may be de-energized and the locking member 32 may be held in the extended position against the biasing force by way of a substantially rigid connection between at least one cable 30 (via the support plate 36) and the extension pivot coupling assembly 28 as will be described further below. Further, as will be described below, the locking member 32 may move to the retracted position under the biasing force of the biasing element 34 when the extension pivot coupling assembly 28 is moved to a locked condition.

The locking member actuator 48 is not limited to those examples described above, however, and other actuators suitable for driving the locking member 32 in at least one direction are envisioned. For example, the locking member actuator 48 may be configured to drive the locking element by way of a power screw or similar screw-thread arrangement. Further, as shown in FIG. 6, in one embodiment, the locking member actuator 48 includes an arm 49 configured to engage and drive the locking member 32. The locking member actuator 48 may be mounted to a portion of the boom 14, and in particular, the base section 16. The locking member actuator 48 may be powered to extend and/or retract, or may be manually driven in one of, or both, directions. In one embodiment, the locking member actuator 48 may be retracted under the force of the biasing element 34.

The stowage coupling assembly 26 may be connected to the jib 20 by way of the bracket 44 using known, suitable fasteners. Accordingly, in one embodiment, the locking member 32, the biasing element 34, and the support plate 36 are either directly or indirectly mounted to the bracket 44, which in turn, is connected the jib 20. In addition, the arm 49 of the locking member actuator 48 may project into the bracket 44 in the locked condition.

Figure 8:
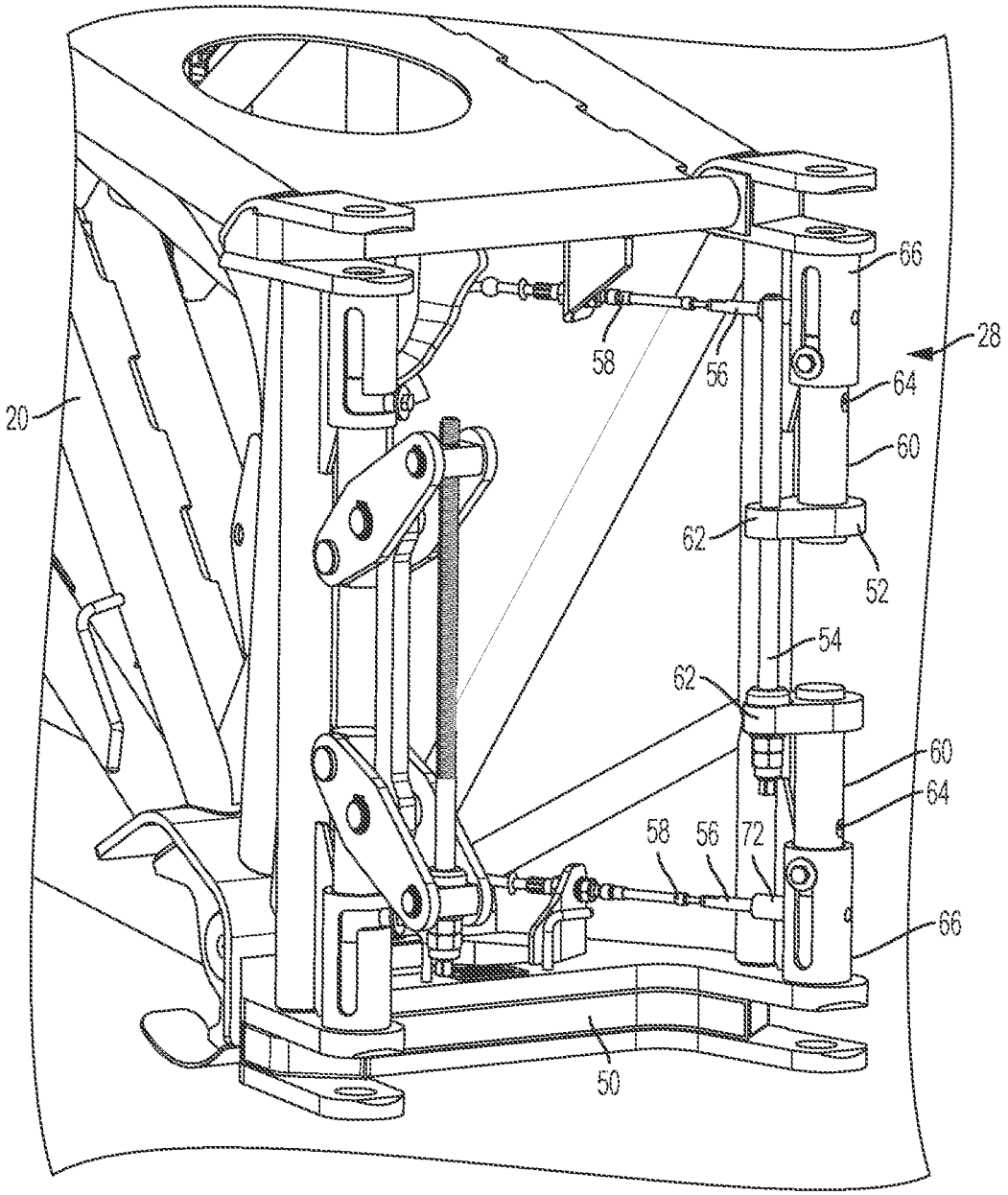
FIG. 8 is an enlarged perspective view of an extension pivot coupling assembly of the jib coupling system of FIG. 4, in a stowage condition, according to an embodiment described herein.
Figure 9:
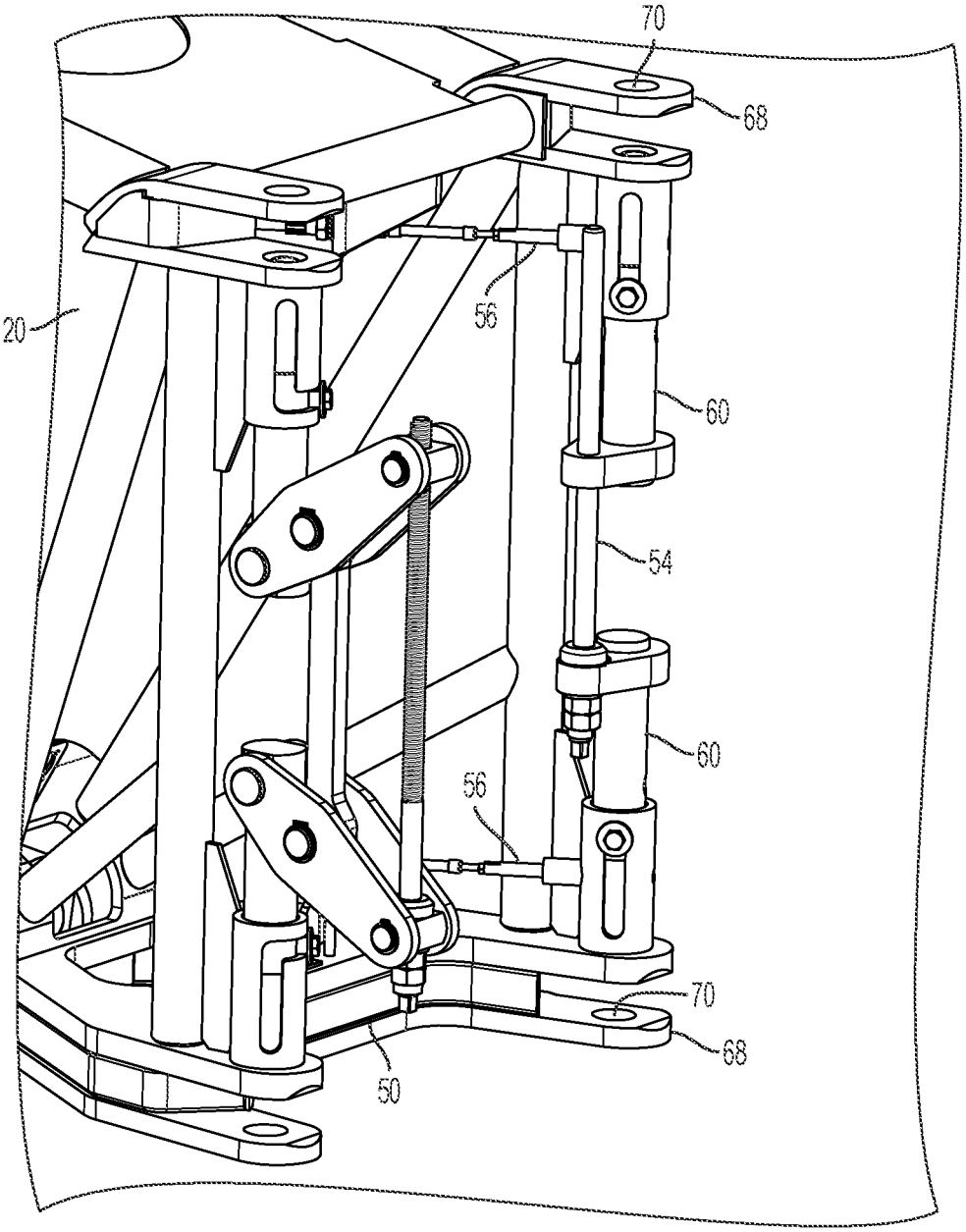
FIG. 9 is another enlarged perspective view of an extension pivot coupling assembly of the jib coupling system of FIG. 4, in a stowage condition, according to an embodiment described herein.
Figure 10:
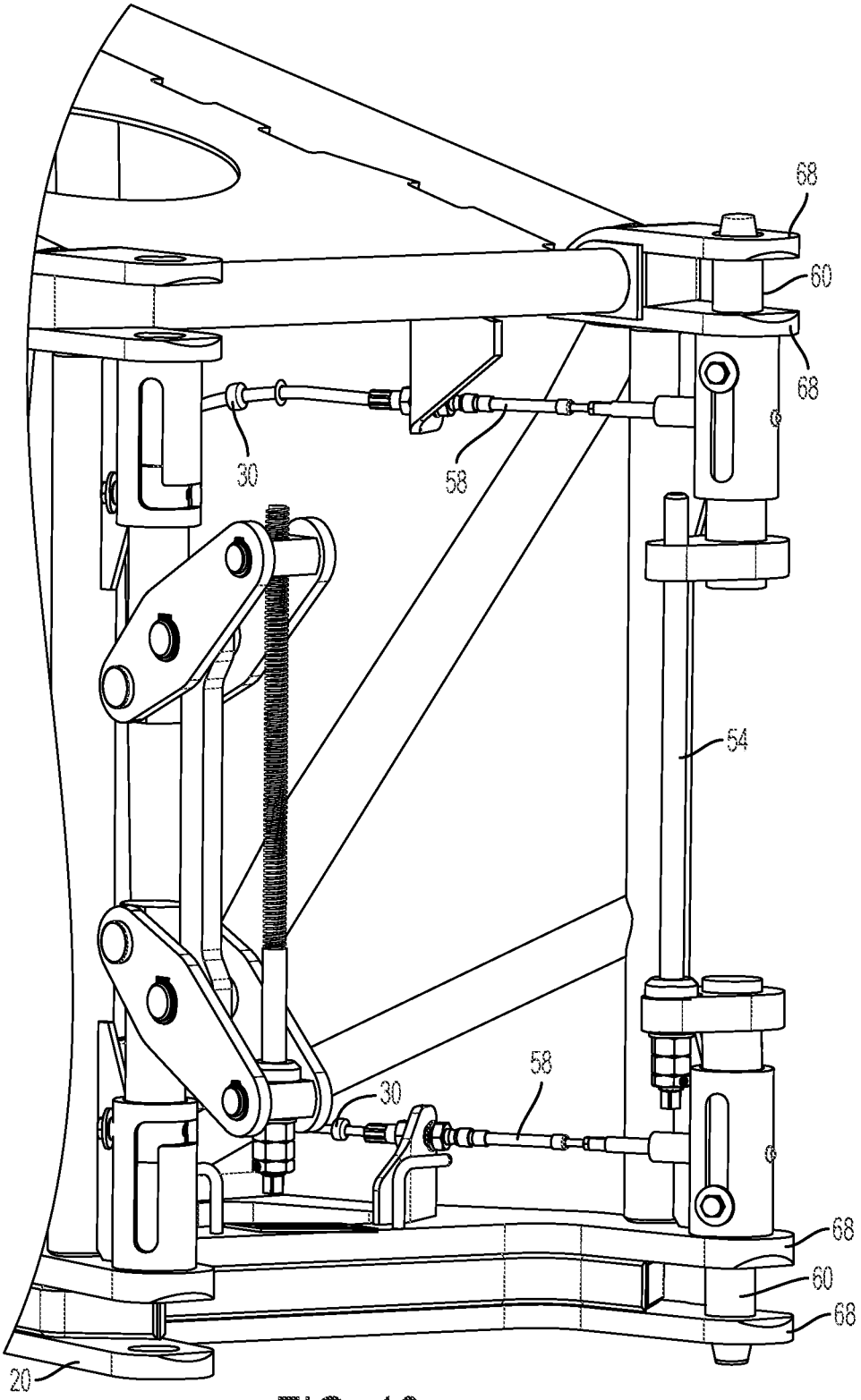
FIG. 10 is an enlarged perspective view of a extension pivot coupling assembly of the jib coupling system of FIG. 4, in an extended condition, according to an embodiment described herein.

FIGS. 8 and 9 show the extension pivot coupling assembly 28 at a mounting end 50 of the jib 20 in an unlocked condition, according to an embodiment described herein. FIG. 10 shows the extension pivot coupling assembly 28 in a locked condition according to an embodiment described herein.

Referring to FIGS. 8-10, the extension pivot coupling assembly 28 generally includes a coupling member 52, a coupling actuator 54 configured to drive the one or more coupling elements 52 and a locking pin 56 at a second end 58 of the one or more cables 30 configured to selectively engage the coupling member 52.

In one embodiment, the coupling member 52 includes coupling pins or bolts 60. The coupling pins 60 are actuated by the coupling actuator 54 to move in substantially opposite directions relative to one another between an extended position (FIG. 10) and a retracted position (FIGS. 8 and 9).

While it is appreciated that any suitable actuator or actuators may be used to drive the coupling pins 60 between the extended and retracted positions, it is preferred that an actuator capable of driving both coupling pins 60 simultaneously is employed. For example, in one embodiment, the coupling actuator 54 is a threaded rod that is operably connected to each coupling pin 60 of the opposed coupling pins 60. Each coupling pin 60 may include an ear 62 having a threaded opening configured to threadably engage the threaded rod 54. Thus, rotation of the threaded rod 54 in one direction causes the ears 62 to move along the threaded rod 54, and turn, drives the coupling pins 60. In one embodiment, the threaded rod 54 includes a section of right hand threads threadably connected to an ear 62 of one of the coupling pins 62, and a second section of left hand threads threadably connected to an ear 62 of the other coupling pin 60, such that rotation of the threaded rod 54 in one direction drives the coupling pins 60 in directions opposite to one another.

The second end 58 of the one or more cables 30 includes the locking pin 56 configured to selectively engage a respective coupling pin 60. For example, each coupling pin 60 may include a positioning opening 64 configured to receive the locking pin 56 in response to movement of the stowage coupling assembly 26 as will be described below. Preferably, the positioning opening 64 is sized to receive the locking pin 56 with a low clearance, to limit movement of the coupling pin 60 when the locking pin 56 is received in the positioning opening 64. In one embodiment, the jib coupling system 24 includes two cables 30, each cable 30 having a first end 38 connected to the support plate 36, and a second end 58 having a locking pin 56. The locking pin 56 of one cable 30 is configured to selectively engage a positioning opening 64 in one of the coupling pins 60, while the locking pin of another cable 30 is configured to selectively engage a positioning opening 64 in the other of the coupling pins 60.

With further reference to FIGS. 8-10, the extension pivot coupling assembly 28 is connected to the jib 20 at the mounting end 50 of the jib 20. In one embodiment, each coupling pin 60 may be slidably disposed in a respective mounting sleeve 66 of the jib 20 and slidable between the extended and retracted positions in response to actuation by the coupling actuator 54 as detailed above. The jib 20 may further include one or more lugs 68 associated with each mounting sleeve 66, each lug 68 having a pin opening 70 configured to selectively receive an associated coupling pin 60 therein, for example, when the coupling pin 60 is in the extended position. Each mounting sleeve 66 may further include a transverse opening 72 (FIG. 8) to receive a portion of the cable 30 and/or the locking pin 56. The transverse opening 72 and the positioning opening 64 in an associated coupling pin 60 are configured to align when the coupling pin 60 is in the extended position. The transverse opening 72 may also serve to hold the locking pin 56 and allow for sliding movement of the locking pin 56 therein.

In one embodiment, the coupling pins 60 are substantially cylindrical in shape, and the openings 70 in the lugs 68 are correspondingly shaped, such that the coupling pins 60 may rotate to allow the jib 20 to pivot to the extended position on the boom 14. In one embodiment, the positioning openings 64 may extend at least partially through the cylindrically shaped coupling pins 60. Alternatively, or in addition, the coupling pins 60 may be formed with an extension in which the positioning openings 64 may be formed.

Figure 11:
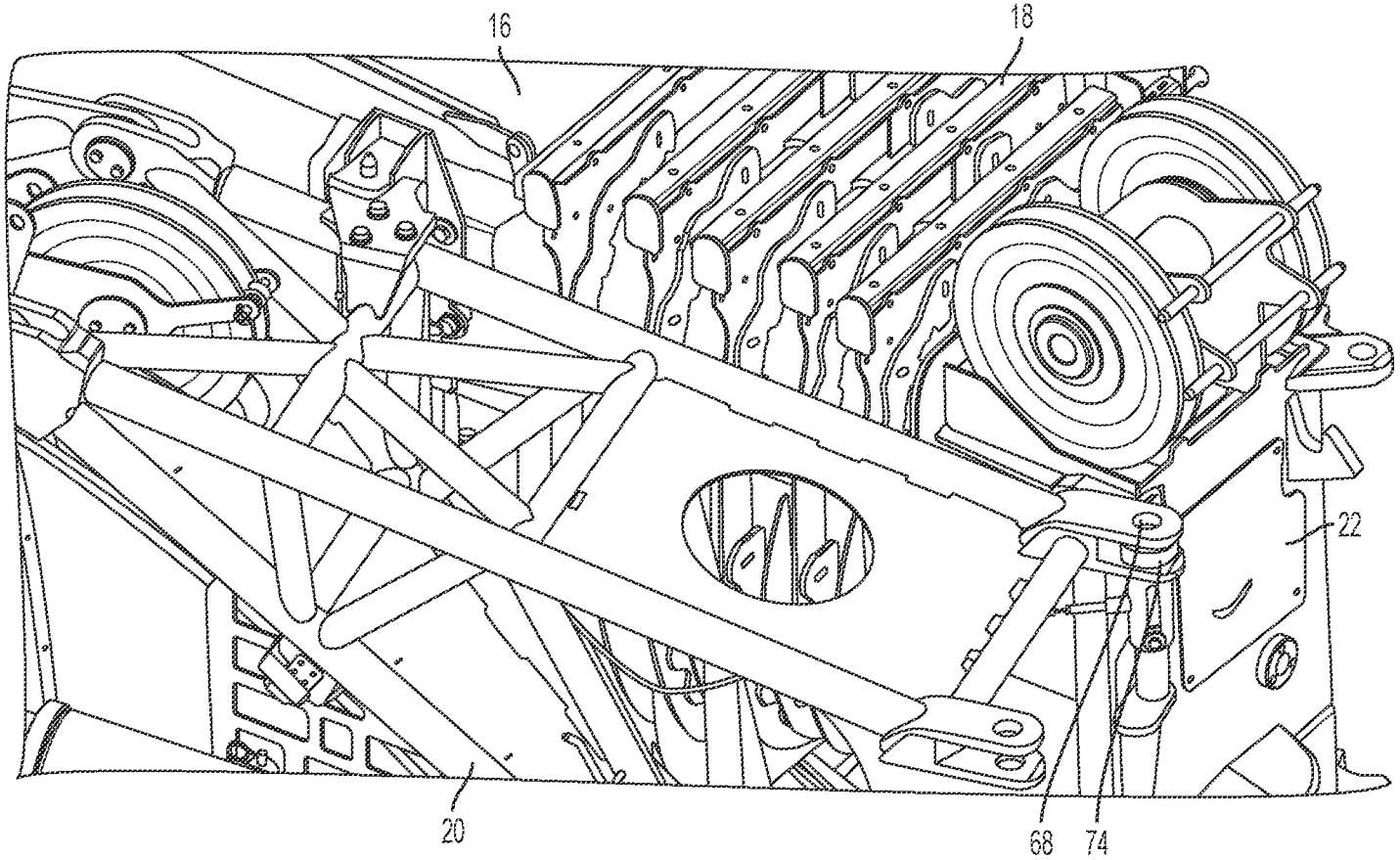
FIG. 11 is a perspective view of a jib pivotably connected to a boom nose for movement from a stowed condition to an extended condition according to an embodiment described herein.
Figure 12:
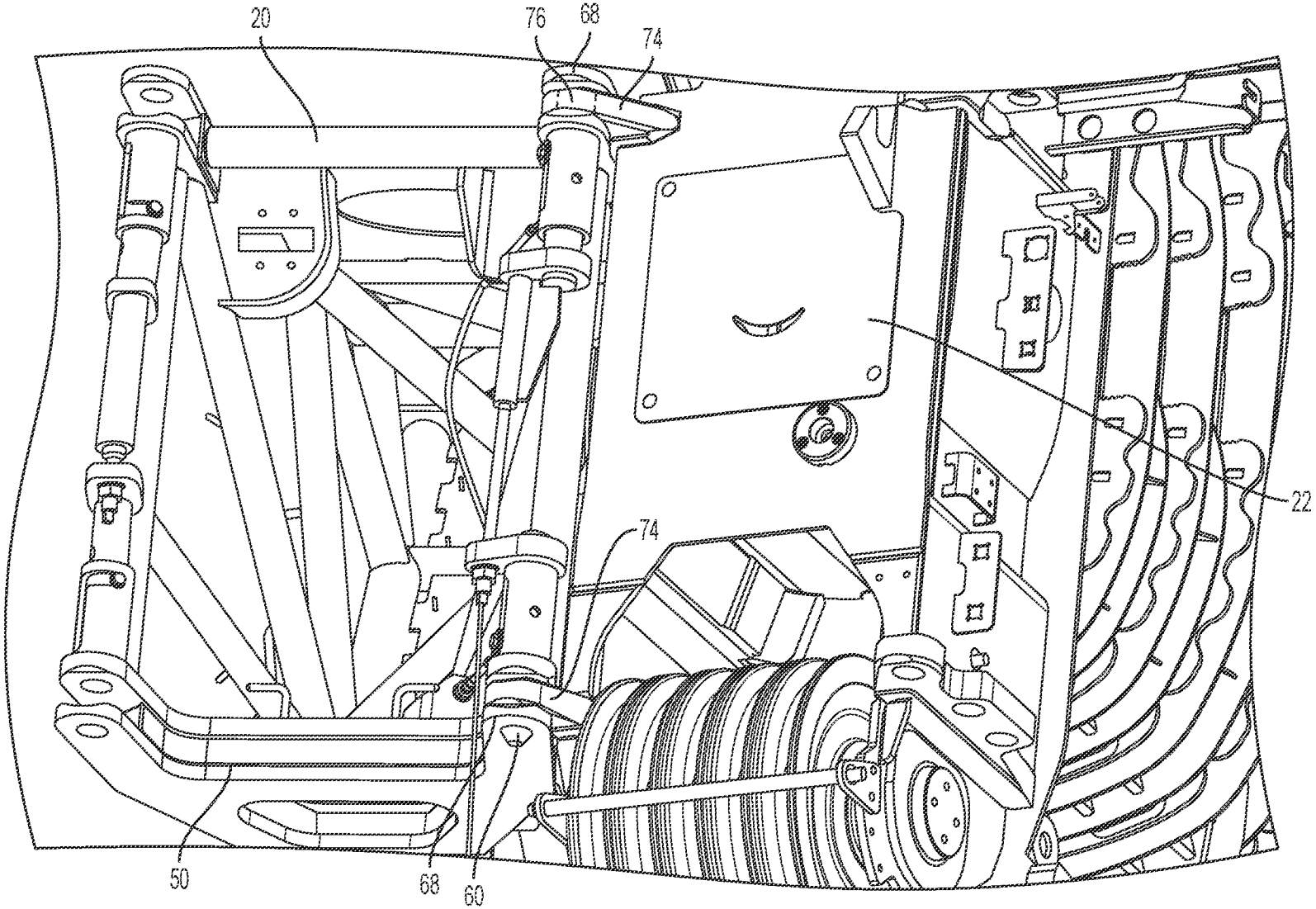
FIG. 12 is another perspective view of a jib pivotably connected to a boom nose for movement from a stowed condition to an extended condition according to an embodiment described herein.

FIGS. 11 and 12 are perspective view showing a boom nose 22 on the boom 14 according to an embodiment described herein. Referring to FIGS. 11 and 12, the boom nose 22 includes boom lugs 74 having boom lug openings 76 configured to selectively receive the coupling pins 60 when the coupling pins 60 are extended. Thus, the jib lugs 68 and boom lugs 74, along with the respective lug openings 70, 76 may be substantially aligned to receive the coupling pins 60 in the extended position. In this manner, the jib 20 may be pivotably coupled to the boom nose 22 at one side of the jib 20 and the boom nose 22. Through this pivotable connection, the jib 20 may be moved from the stowed condition to the extended condition and vice versa. In one embodiment, the boom nose 22 includes upper and lower boom lugs 74 configured to align with upper and lower jib lugs 68. The coupling pins 60 may be formed as upper and lower coupling pins 60 which are configured to extend into the upper and lower lugs of the jib 20 and boom nose 22.

Figure 13:
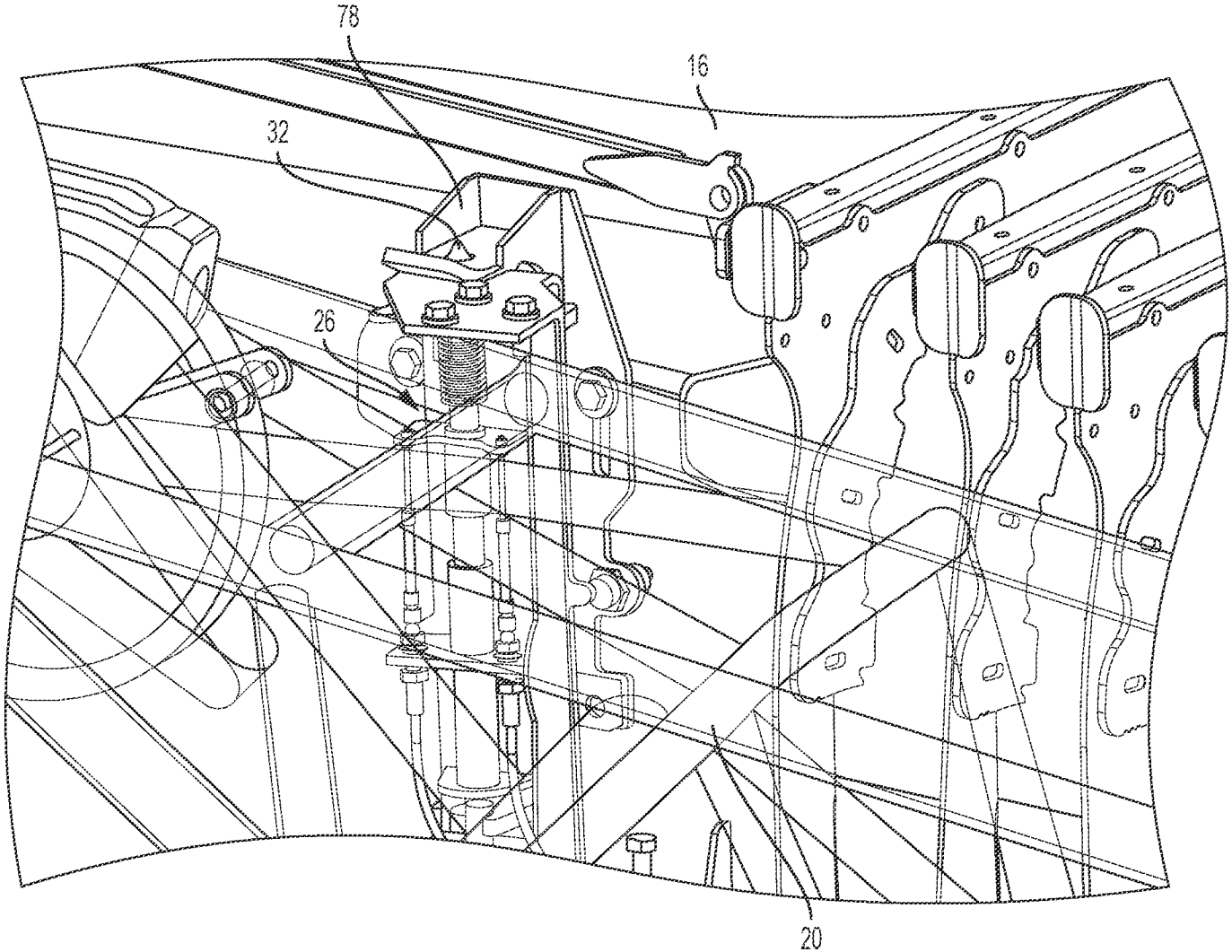
FIG. 13 is a perspective view a jib connected to a base section of a boom according to an embodiment described herein.

FIG. 13 is a perspective view showing a stowage lug 78 on the base section 16 of the boom 14. The stowage lug 78 includes an opening configured to receive the locking member 32 when the locking member 32 is actuated to the extended position. In this manner, the jib 20 may be coupled or locked to the base section 16 of the boom 14 for stowage. The opening in the stowage lug 78 may be substantially cylindrical, corresponding to a shape of the locking member 32, to allow for the jib 20 to pivot about the locking member 32 between a fully stowed or transit position and a position where the jib lugs 68 may be aligned with the boom lug 74 for connection thereto by way of the coupling pins 60.

It is understood that the terminology "upper" and "lower" is used for the purposes of example, and the present disclosure is not limited to such a configuration. For example, in one embodiment, the boom lugs 74 could be found at left and right sides of a boom nose 22.

In operation, the jib 20 may be initially held in the stowed condition, alongside, or on top of, the base section 16 of the boom 14 as shown in FIG. 3. Referring to FIGS. 4, 6 and 13, in the stowed condition, the locking member 32 is in the extended condition such that it projects through the opening in the stowage lug 78 on base section 16 of the boom 14. As best shown in FIG. 6, the locking member 32, in the extended position, is raised toward an upper end of the bracket 44 by the locking member actuator 48 and the biasing element 34 is loaded to urge the locking member 32 toward the retracted position shown in FIG. 5. Similarly, the support plate 36, connected to the locking member 32, is in raised position and holds the one or cables 30 in a raised position as well.

Referring to FIGS. 4, 8 and 9, with the jib 20 in the stowed condition, the coupling pins 60 of the extension pivot assembly 28 are in the retracted position. In addition, the mounting end 50 of the jib 30 may be spaced from and/or positioned alongside the boom nose 22. Further, the locking pin 56 at the second end 58 of each cable 30 is positioned outside of the positioning opening 64 of the coupling pin 60. In one embodiment, the locking pin 56 is urged against an outer surface of the locking pin 60 by way of an biasing force applied by the biasing element 34 to the support plate 36, which then applies a pushing force on the cable, and in turn, the locking pin 56. Because the locking pin 56 is held against an outer surface of the coupling pin 60, downward movement of the locking member 32 may be prevented by way of a reaction force through the locking pin 56, the cable 30 and the support plate 36. The position of the actuator 48 in its extended position also prevents downward movement of the locking member 32.

To move the jib 20 to the extended condition, the jib 20 is pivoted about the locking member 32 at the stowage coupling assembly 26 to move the mounting end 50 of the jib 20 toward the boom nose 22. In particular, with reference to FIGS. 11 and 12, the jib 20 may be pivoted about the locking member 32 to bring the jib lugs 68 and boom lugs 74, as well as their respective openings 70, 76 into alignment with one another. In this position, downward movement, i.e., retraction, of the locking member is still prohibited due to the reaction force of the cable 30 acting on the support plate 36 and locking member against the biasing force from the biasing element 34.

Turning to FIGS. 5 and 8-10, with the jib lugs 68 and boom lugs 74 aligned, the coupling pins 60 may be actuated to move from the retracted position in FIGS. 8 and 9 to the extended position shown in FIGS. 5 and 10. Movement of a coupling pin 60 to an extended position moves the positioning opening 64 relative to the locking pin 56 until the positioning opening 64 and locking pin 56 are substantially aligned. At this point, the locking member actuator 48 is disengaged so that it may be retracted. Once aligned, and with the locking member actuator 48 and locking member 32 moved to the retracted position, the locking pin 56 is urged or pushed, under the force of the biasing element 34 through the cable 30, into the positioning opening 64 of the coupling pin 60, as shown in FIG. 10. Now referring to FIGS. 5 and 7, concurrently, as noted above, under the biasing force from the biasing element 34, the locking member 32 and support plate 36, along with the locking member actuator 48, are moved to the retracted position. With the locking member 32 retracted, the stowage coupling assembly 26 is in the unlocked condition, while the extension pivot coupling assembly 28, with the coupling pins 60 extended, is in a locked condition. With the locking pin 56 in the positioning opening 54, movement of the coupling pin 60 is substantially prohibited.

With the coupling pins 60 extended and engaged in the openings of the jib lugs 68 and boom lugs 74, and the locking member 32 of the stowage coupling assembly 26 retracted and disengaged from the stowage lug 78 of the base section 16, the jib 20 may pivoted about the coupling pins 60 to bring the mounting end 50 of the jib 20 into substantially axial alignment with the boom nose 22 so that that jib 20 may be secured to the boom nose 22 for operation.

To move the jib 20 from the extended condition to the stowed condition, the jib 20 is pivoted about the coupling pins 60 from the boom nose 22 toward the base section 16 until the locking member 32 is substantially aligned with the stowage lug 78. The locking member actuator 48 can be energized to drive the locking member 32 to the extended position, against the biasing force from the biasing element 34, such that the locking member 32 extends into the opening of the stowage lug 78 and the stowage coupling assembly 26 is in the locked condition. Movement of the locking member 32 to the extended position causes movement of the support plate 36 and the first end 38 of the cable 30. Accordingly, the support plate 36 applies a pulling force to cable 30 which causes the locking pin 56 at the second end 58 of the cable 30 to retract or disengage from the positioning opening 64 in the coupling pin 60.

It will be recognized that by mounting the locking member actuator 48 on the boom 14, the locking member 32 may pivot away from, and toward, the actuator 48 with pivoting movement of the jib 20. In order for the actuator 48 to drive the locking member 32 to the extended position, the locking member 32 is pivoted to a position where it is substantially aligned with the actuator 48 and the stowage lug 78. In this manner, it may be assured that when the locking member 32 is actuated to the extended position, it will engage the stowage lug 78 to couple the jib 20 to the base section 16.

With the locking pin 56 removed from the coupling pin 60, the coupling actuator 54 may be operated to actuate the coupling pins 60 to the retracted position where the coupling pins 60 are withdrawn from the boom lug openings 76. Accordingly, the jib 20 may be pivoted on the locking member 32 such that the mounting end 50 of the jib 20 moves away from the boom nose 22. Additional stowage coupling devices may then be operated to secure the jib 20 in the stowed condition.

Accordingly, in the embodiments above, a jib may be moved from a stowed condition to an extended condition, and vice versa, on a boom while remaining coupled to the boom by at least one coupling assembly at all times. By way of the interactive and interconnected relationship between the stowage coupling assembly, the one or more cables, and the extension pivot coupling assembly, simultaneous decoupling of the stowage coupling and extension pivot coupling assemblies is substantially prohibited. In addition, in the embodiments above, the one or more cables are driven only from the stowage coupling assembly. That is, the one or more cables are pushed and pulled from the first end only, which reduces parts and complexity of the jib coupling system.

It is understood that the features described with respect to any of the embodiments above may be implemented, used together with, or replace features described in any of the other embodiments above. It is also understood that description of some features may be omitted in some embodiments, where similar or identical features are discussed in other embodiments. Further, it is understood that the jib coupling system described above may be substantially reversed such that the locking pin at the second end of the cable is configured to interact with the locking member at an intermediate area of the jib.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular. In addition, in is understood that terminology referring to directions or relative orientations, such as, but not limited to, "upper" "lower" "raised" "lowered" "top" "bottom" "above" "below" "alongside" "left" and "right" are used for purposes of example and do not limit the scope of the subject matter described herein to such orientations or relative positioning.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A jib coupling system for coupling a jib to a boom, comprising:

a stowage coupling assembly having a locking member movable between a retracted position and an extended position;

an extension pivot coupling system having a coupling member movable between a retracted position and an extended position; and a cable having a first end operably connected to the locking member and a second end having a locking pin, wherein movement of the locking member from the extended position to the retracted position causes the locking pin to engage the coupling member, and movement of the locking member from the retracted position to the extended position causes the locking pin to disengage the coupling member.

2. The jib coupling system of claim 1, wherein the coupling member is held against movement relative to the locking pin when the locking pin is engaged with the coupling member, and the coupling member is movable between extended and retracted positions when the locking pin is disengaged from the coupling member.

3. The jib coupling system of claim 1, wherein the coupling member comprises first and second coupling pins, each coupling pin having a positioning opening.

4. The jib coupling system of claim 3, wherein the cable includes two cables, and the locking pin of each cable is configured to selectively engage the positioning opening of the first and second coupling pins.

5. The jib coupling system of claim 1, further comprising a coupling actuator configured to move the coupling member between the retracted and extended positions.

6. The jib coupling system of claim 1, wherein the stowage coupling assembly further comprises a locking member actuator configured to move the locking member from the retracted position to the extended position.

7. The jib coupling system of claim 6, wherein the stowage coupling assembly further comprises a biasing element urging the locking member to the retracted position, wherein the locking member actuator is configured to move the locking member against a biasing force from the biasing element.

8. The jib coupling system of claim 7, wherein the stowage coupling assembly further comprises a support plate connected to the locking member, wherein the first end of the cable is connected to the locking member via the support plate.

9. The jib coupling system of claim 8, wherein the locking pin is urged against an outer surface of the coupling member when the coupling member is in the retracted position, and a reaction force from contact between the locking pin and coupling member is supplied through the cable to and the support plate to hold the locking member in the extended position.

10. The jib coupling system of claim 8, wherein the locking pin is urged into a positioning opening of the coupling member under the biasing force of the biasing element supplied through the support plate and cable, when the coupling member is in the extended position.

11. A boom assembly for a construction vehicle, comprising:

a boom having a base section and boom nose;

a jib movable relative to the base section between a stowed condition and an extended condition; and a jib coupling system configured to couple the jib to the boom, the jib coupling system comprising:

a stowage coupling assembly having a locking member movable between a retracted position and an extended position;

an extension pivot coupling system having a coupling member movable between a retracted position and an extended position; and a cable having a first end operably connected to the locking member and a second end having a locking pin, wherein movement of the locking member from the extended position to the retracted position causes the locking pin to engage the coupling member, and movement of the locking member from the retracted position to the extended position causes the locking pin to disengage the coupling member.

12. The boom assembly of claim 11, wherein the base section comprises a stowage lug having an opening configured to receive the locking member when the locking member is in the extended position.

13. The boom assembly of claim 12, wherein the boom nose comprises a boom lug having an opening and a mounting end of the jib comprises a jib lug having an opening, wherein the openings of the boom lug and the jib lug are configured to be aligned to receive the coupling member when the coupling member is in the extended position.

14. The boom assembly of claim 13, wherein the jib is pivotable on the locking member when the locking member is in the extended position to align the boom lug and jib lug.

15. The boom assembly of claim 11, wherein the coupling member comprises first and second coupling pins, each coupling pin having the positioning opening, and the cable includes two cables, wherein the locking pin of each cable is configured to selectively engage a positioning opening of the first and second coupling pins.

16. The boom assembly of claim 11, wherein the stowage coupling assembly further comprises a biasing element urging the locking member to the retracted position.

17. The boom assembly of claim 16, wherein the locking pin is urged against an outer surface of the coupling member when the coupling member is in the retracted position, and a reaction force from contact between the locking pin and coupling member is supplied through the cable to hold the locking member in the extended position against a biasing force from the biasing element.

18. The boom assembly 16, wherein the locking pin is urged into a positioning opening of the coupling member under the biasing force of the biasing element supplied through the cable, when the coupling member is in the extended position.

19. The boom assembly of claim 11, wherein the boom is a telescoping boom and further comprises one or more telescoping sections nested within the base section, and the boom nose is on an outermost extending telescoping section.

20. A mobile crane comprising:

a boom assembly having a base section, a boom nose, and a jib movable relative to the base section between a stowed condition and an extended condition; and a jib coupling system configured to couple the jib to the boom, the jib coupling system comprising:

a stowage coupling assembly having a locking member movable between a retracted position and an extended position;

an extension pivot coupling system having a coupling member movable between a retracted position and an extended position; and a cable having a first end operably connected to the locking member and a second end having a locking pin, wherein movement of the locking member from the extended position to the retracted position causes the locking pin to engage the coupling member, and movement of the locking member from the retracted position to the extended position causes the locking pin to disengage the coupling member.

* * * * *